US005997716A

United States Patent [19]

Roberts et al.

[11] Patent Number: 5,997,716

[45] Date of Patent: Dec. 7, 1999

[54] METHOD OF ELECTROCHEMICALLY PRODUCING EPOXIDES

[75] Inventors: David G. Roberts, Gibsonia; Peter C. Foller, Murrysville; Robert H. Tang, Murrysville; Yingchao Zhang, Murrysville, all of Pa.

[73] Assignee: PPG Industries Ohio, Inc., Cleveland, Ohio

[21] Appl. No.: 09/112,660

[22] Filed: Jul. 9, 1998

[51] Int. Cl.[6] ..... C25B 3/00

[52] U.S. Cl. ..... 205/428; 205/456

[58] Field of Search ..... 205/428, 456

[56] References Cited

U.S. PATENT DOCUMENTS

| | | | |
|---|---|---|---|
| 3,288,692 | 11/1966 | Le Duc | 204/80 |
| 3,351,635 | 11/1967 | Kollar | 260/348.5 |
| 3,427,235 | 2/1969 | Le Duc | 204/78 |
| 3,451,905 | 6/1969 | Krönig et al. | 204/80 |
| 3,501,388 | 3/1970 | Krönig et al. | 204/79 |
| 3,635,803 | 1/1972 | Binns et al. | 204/80 |
| 4,324,625 | 4/1982 | Cumbo | 204/72 |
| 4,560,451 | 12/1985 | Nielsen | 204/79 |
| 4,634,506 | 1/1987 | Novak et al. | 204/80 |
| 4,726,887 | 2/1988 | McIntyre | 204/80 |
| 5,411,641 | 5/1995 | Trainham, III et al. | 204/59 R |
| 5,527,436 | 6/1996 | Cooker et al. | 204/428 |
| 5,876,579 | 3/1999 | Gorzynski | 204/523 |
| 5,906,722 | 5/1999 | Foller et al. | 204/539 |

FOREIGN PATENT DOCUMENTS

| | | |
|---|---|---|
| 637691 | 3/1964 | Belgium . |
| 1258856 | 1/1968 | Germany . |
| 1090006 | 11/1967 | United Kingdom . |

OTHER PUBLICATIONS

Holbrook et al., "Electrooxidation of Olefins at a Silver Electrode", *Journal of Catalysis*1975, vol. 38, pp. 294–298. No month available.

Choue et al., "Anodic Oxidation of Propylene on a Screen Electrode", *Chemical Engineering Science 1980,* vol. 35, pp. 1581–1590. No month available.

Van Der Eijk et al., "Electrochemical Epoxidatin of Olefins", *Catalysis Today 1988,* vol. 3, pp. 259–266. No month available.

(List continued on next page.)

*Primary Examiner*—Kathryn Gorgos
*Assistant Examiner*—Edna Wong
*Attorney, Agent, or Firm*—James R. Franks; Irwin M. Stein

[57] ABSTRACT

Described is a method of electrochemically converting α-halohydrins, e.g., 1-chloro-2-hydroxypropane and 1,3-dichloro-2-hydroxypropane, to epoxides, e.g., propylene oxide and epichlorohydrin. A three compartment electrolytic cell is provided having (1) a catholyte compartment containing a cathode assembly comprising a cathode and an anion exchange membrane, (2) an anode compartment containing an anode assembly comprising either (a) a hydrogen consuming gas diffusion anode and a current collecting electrode or (b) a hydrogen consuming gas diffusion anode which is fixedly held between a hydraulic barrier and a current collecting electrode, and (3) an intermediate compartment separated from the catholyte and anode compartments by the anion exchange membrane and either (i) the hydrogen consuming gas diffusion anode or (ii) the hydraulic barrier respectively. An aqueous solution of α-halohydrin is charged to the catholyte compartment, while hydrogen gas is charged to the anode compartment and an aqueous electrolyte solution is charged to the intermediate compartment. Direct current is passed through the electrolytic cell and an aqueous solution comprising epoxide is removed from the catholyte compartment.

20 Claims, 3 Drawing Sheets

OTHER PUBLICATIONS

Scott et al., Pilot Scale Electrosynthesis of Alkene Oxides by Direct and Indirect Oxidation in Sieve Plate Electrochemical Reactor, *Chemical Engineering Science* 1992, vol. 47, pp. 2957–2962. No month available.

Odouza et al., Aspects of the Direct Electrochemical Oxidation of Propylene, *Chem. Eng. Symp. Series* 1994, No. 127, pp. 37–47. No month available.

Otsuka et al., Simultaneous Epoxidation of 1–Hexene and Hydroxylation of Benzene During Electrolysis of Water, *Chemistry Letters* 1994, pp. 1861–1864. No month available.

Otsuka et al., Electrocatalytic Synthesis of Propylene Oxide During Water Electrolysis, *Journal of Catalysis* 1995, vol. 157, pp. 450–460. No month available.

METHOD OF ELECTROCHEMICALLY PRODUCING EPOXIDES

DESCRIPTION OF THE INVENTION

The present invention relates to a method of electrochemically producing epoxides, e.g., alkylene oxides and epihalohydrins. Particularly, the present invention relates to an electrochemical method of converting α-halohydrin to epoxide. The present invention also relates to the use of electrolytic cells having an intermediate compartment separated from a catholyte compartment by an anion exchange membrane and from an anode compartment by either a hydraulic barrier or a hydrogen consuming gas diffusion anode.

Commercial methods of producing epoxides, such as alkylene oxides include, for example: vapor phase oxidation of alkylene, e.g., ethylene, with molecular oxygen in the presence of a silver catalyst; catalytic reaction of alkylene, e.g., propylene, with an organic hydroperoxide, as described in U.S. Pat. No. 3,351,635; and what is known in the art as the halohydrin process. The halohydrin process, e.g., chlorohydrin process, is among the most common commercial methods of producing alkylene oxide, e.g., propylene oxide. The production of propylene oxide by the chlorohydrin process typically comprises three steps, chlorohydrination, dehydrochlorination, i.e., epoxidation, and product separation.

Chlorohydrination involves the reaction of propylene with chlorine in aqueous solution to form two isomers of propylene chlorohydrin. In the dehydrochlorination step, alkali metal hydroxide, such as sodium hydroxide, or milk of lime is added to the aqueous propylene chlorohydrin solution to form an aqueous solution of propylene oxide, organic co-products and brine, e.g., an aqueous salt solution such as aqueous sodium chloride. Separation of propylene oxide and organic co-products from the brine typically involves an evaporative or distillation process. Propylene oxide is usually separated from the organic co-products by fractional distillation. The presence of halide anion, e.g., chloride anion, in the brine requires that the distillation column(s) be fabricated from expensive corrosion resistant materials, such as titanium and stainless steel. Moreover, the waste water resulting from the distillation process is typically treated prior to disposal to remove trace amounts of organic compounds.

In the most common process of manufacturing epichlorohydrin, allyl chloride is reacted with chlorine in aqueous solution to give a mixture of 1,2-dichloro-3-propanol and 1,3-dichloro-2-propanol, sometimes referred to as an isomeric mixture of glycerol chlorohydrins. This isomeric mixture is dehydrochlorinated with an alkali and the resulting epichlorohydrin separated by steam stripping. Final purification can be accomplished by distillation. As with the above described chlorohydrin process, distillation column(s) are typically fabricated from expensive corrosion resistant materials, and the distillation waste water treated prior to disposal. In addition, contact times in all steps must be carefully controlled to minimize hydrolysis of the epichlorohydrin.

The commercial methods described above can be expensive, particularly with regard to the cost of distillation equipment, utility costs, raw material costs and the required treatment of waste streams. As a result, such methods are dedicated typically to the high volume production of epoxides and can be expensive to expand.

Methods of electrochemically producing alkylene oxides, which utilize a variety of electrochemical cell configurations and feed streams have been described in, for example, U.S. Pat. Nos. 3,288,692; 3,427,235; 3,451,905; 3,501,388; 3,635,803; 4,560,451; 4,634,506; 4,726,887; and 5,527,436. The described electrochemical cell configurations include, single compartment, two compartment and bipolar stacked arrays. The described feed streams include, water, oxygen, alkali metal halide, e.g., potassium bromide, and olefin, e.g., propylene.

Because of the drawbacks of current commercial methods, alternative methods for producing epoxides, e.g., alkylene oxides such as propylene oxide, that are lower in cost with regard to capital investment for equipment, raw material costs, and costs for the treatment of waste streams are continually being sought. In accordance with an embodiment of the present invention, a method of converting α-halohydrins to epoxides, e.g., alkylene oxide, is provided, said method comprising:

(a) providing an electrolytic cell having (1) a catholyte compartment containing a cathode assembly, (2) an anode compartment containing an anode assembly, and (3) an intermediate compartment separating said catholyte and anode compartments; said cathode assembly comprising a cathode and an anion exchange membrane, said anode assembly comprising a hydrogen consuming gas diffusion anode and a current collecting electrode, and said intermediate compartment being separated from said catholyte and said anode compartments by said anion exchange membrane and said hydrogen consuming gas diffusion anode;

(b) introducing an aqueous solution comprising α-halohydrin into said catholyte compartment;

(c) introducing hydrogen gas into said anode compartment;

(d) introducing an aqueous electrolyte solution into said intermediate compartment;

(e) passing direct current through said electrolytic cell; and (f) removing an aqueous solution comprising epoxide from said catholyte compartment.

In accordance with another embodiment of the present invention, there is provided a method of producing epoxide as recited above wherein the anode assembly further comprises a hydraulic barrier, the hydrogen consuming gas diffusion anode being fixedly held between the hydraulic barrier and the current collecting electrode, and the intermediate compartment being separated from the anode compartment by the hydraulic barrier.

The features that characterize the present invention are pointed out with particularity in the claims which are annexed to and form a part of this disclosure. These and other features of the invention, its operating advantages and the specific objects obtained by its use will be more fully understood from the following detailed description and the accompanying drawings in which preferred embodiments of the invention are illustrated and described.

Other than in the operating examples, or where otherwise indicated, all numbers expressing quantities of ingredients, concentrations, reaction conditions, and so forth used in the specification and claims are to be understood as modified in all instances by the term "about".

BRIEF DESCRIPTION OF THE DRAWINGS

In FIGS. 1–3, like reference numerals represent the same structural parts, the same process streams and the same conduits.

DETAILED DESCRIPTION OF THE INVENTION

Figure 1:
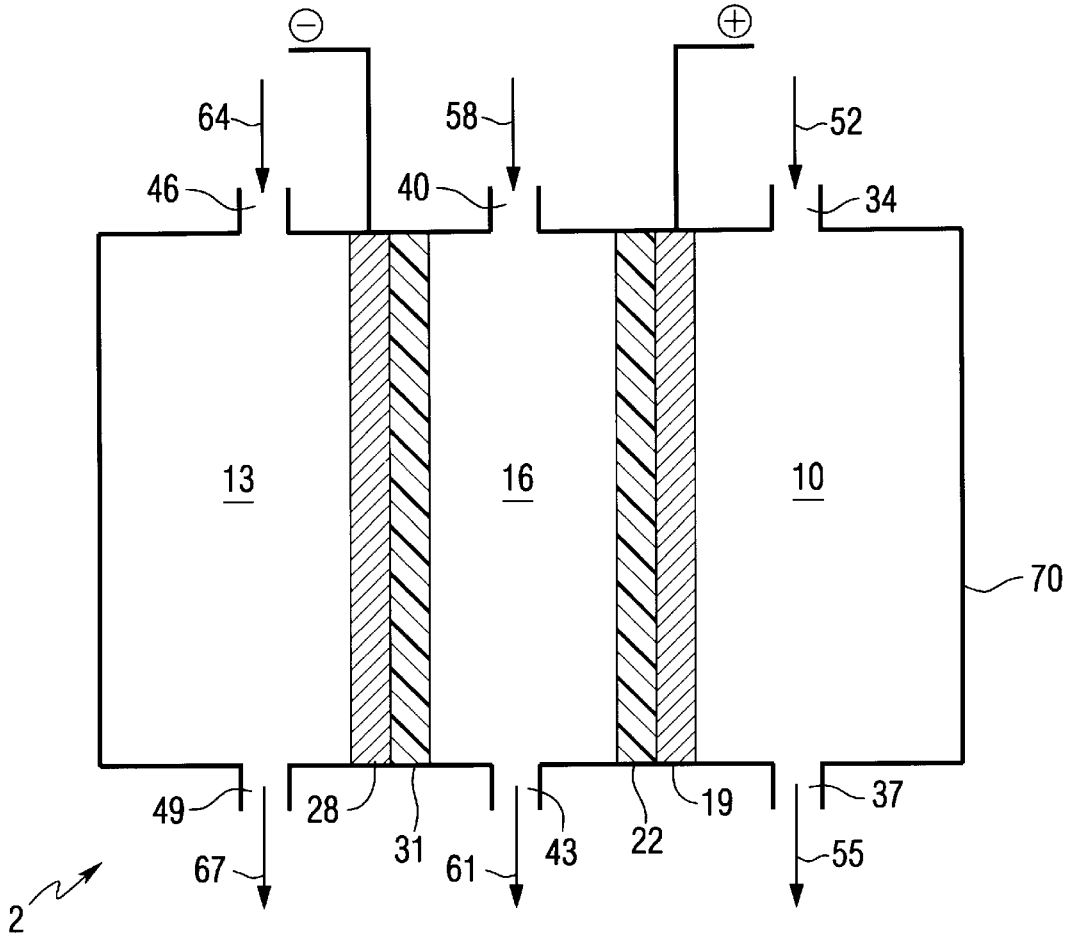
FIG. 1 is a schematic representation of an electrolytic cell useful for producing epoxide in accordance with an embodiment of the method of the present invention.
Figure 2:
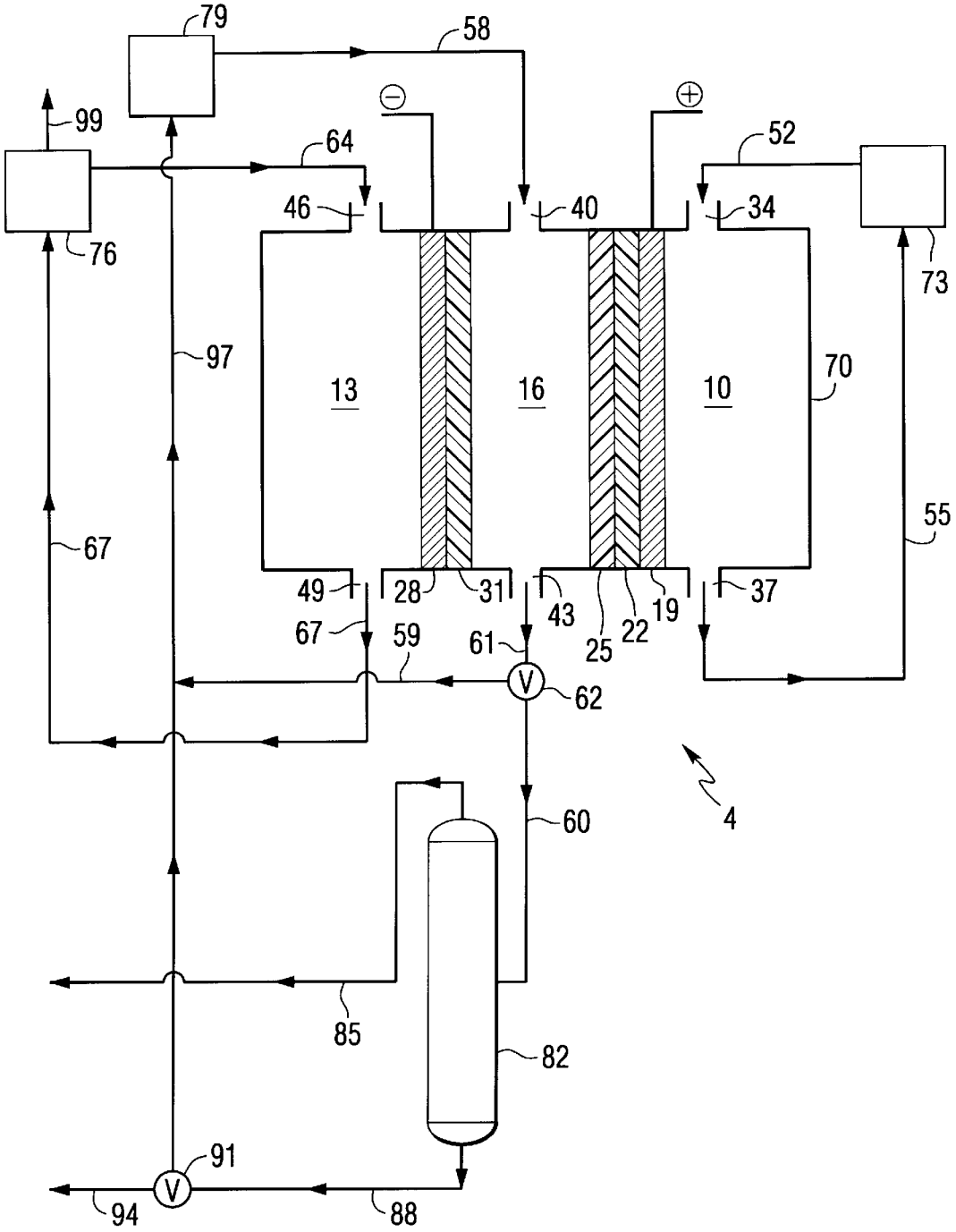
FIG. 2 is a schematic representation of an electrolytic cell similar to that shown in FIG. 1 wherein the anode assembly further includes a hydraulic barrier, and further illustrating the flow of circulating process streams around the catholyte, anode and intermediate compartments, and the treatment of a process stream removed from the intermediate compartment.
Figure 3:
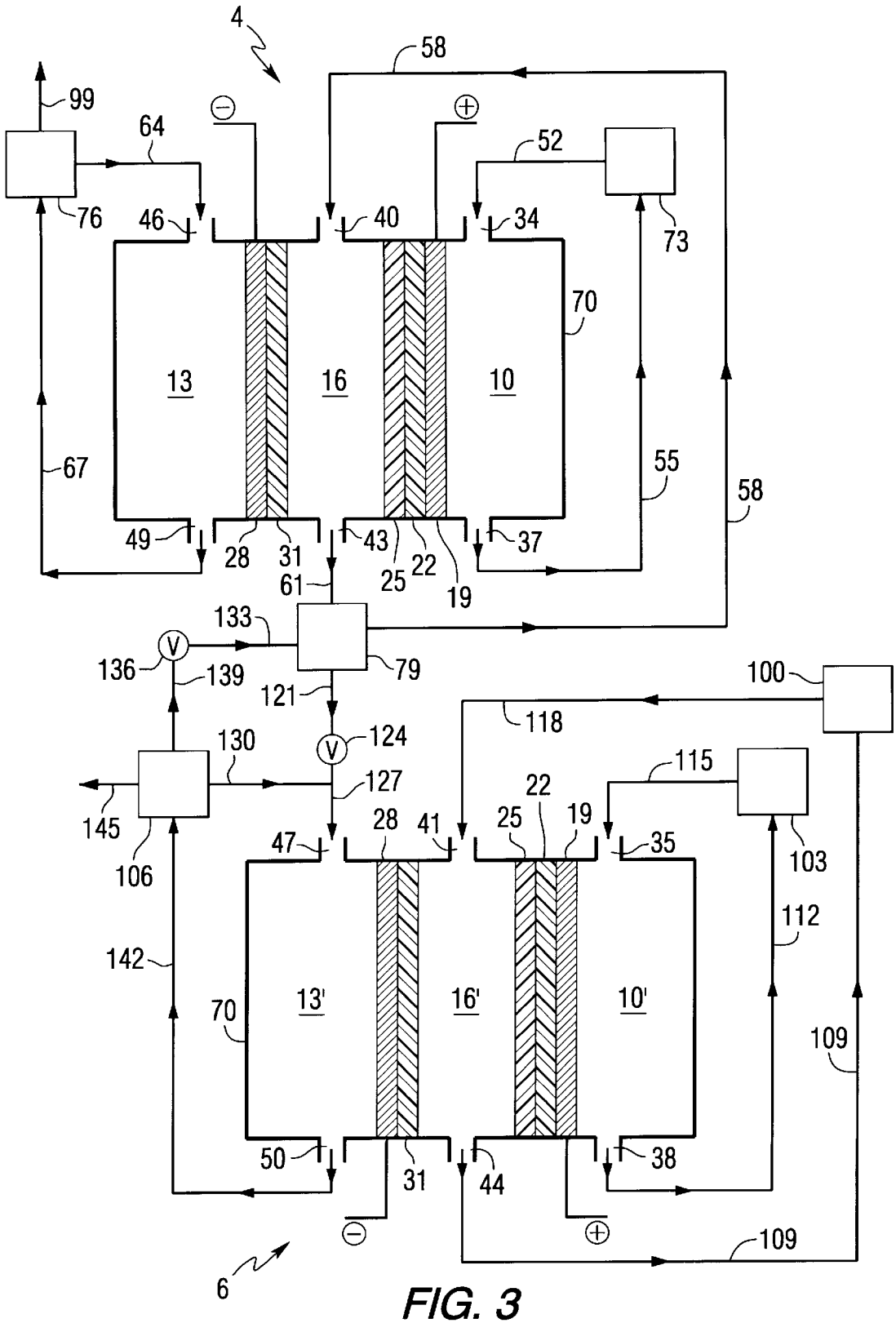
FIG. 3 is a schematic representation of the electrolytic cell depicted in FIG. 2 wherein at least a portion of a process stream removed from the intermediate compartment is treated by introducing it into the catholyte compartment of a separate electrolytic cell similar to that depicted in FIG. 2.

In the practice of the present invention, electrolytic cells, such as those represented in FIGS. 1 through 3, are provided for the production of epoxides from α-halohydrins. Referring now to FIG. 1, electrolytic cell 2 comprises a housing 70 having therein a catholyte compartment 13, an anode compartment 10, and an intermediate compartment 16. The catholyte compartment 13 has an inlet 46 and an outlet 49, and also has therein a cathode assembly comprising a cathode 28, which is substantially rigid and provides support for anion exchange membrane 31. The anode compartment 10 has an inlet 34 and an outlet 37, and also has therein an anode assembly comprising a hydrogen consuming gas diffusion anode 22 and a current collecting electrode 19. The intermediate compartment 16 has an inlet 40 and an outlet 43, and is separated from the catholyte compartment 13 by anion exchange membrane 31, and from the anode compartment 10 by hydrogen consuming gas diffusion anode 22, more particularly, the anode assembly.

In FIGS. 2 and 3 the anode assemblies of electrolytic cells 4 and 6 each comprise hydrogen consuming gas diffusion anode 22 which is fixedly held between a hydraulic barrier 25 and current collecting electrode 19. The intermediate compartments 16 and 16' of electrolytic cells 4 and 6 respectively are each separated from anode compartments 10 and 10' by hydraulic barrier 25.

The electrolytic cells of FIGS. 1–3 may be assembled by any appropriate method as long as the basic structural arrangements of component parts, as depicted in FIGS. 1–3, are maintained. For example, the catholyte, anode and intermediate compartments may each be fabricated separately and then assembled by clamping or otherwise fastening the compartments together.

Housing 70 may be fabricated from any of the known conventional materials for electrolytic cells, or combinations of these known materials, that are preferably at least corrosion resistant to, and compatible with the materials comprising the process streams present within or circulated through the catholyte, anode and intermediate compartments or formed in these compartments. Examples of materials from which housing 70 may be fabricated include, but are not limited to: metal, e.g., stainless steel, titanium and nickel; and plastics, e.g., poly(vinylidene fluoride), polytetrafluoroethylene, which is sold under the trademark "TEFLON", and which is commercially available from E.I. du Pont de Nemours and Company, glass filled polytetrafluoroethylene, polypropylene, poly(vinyl chloride), chlorinated poly(vinyl chloride) and high density polyethylene. Preferred materials from which housing 70 may be fabricated include: poly(vinylidene fluoride) and stainless steel.

If housing 70 is fabricated from an electrically conductive material, such as stainless steel, then appropriately positioned nonconductive gaskets would typically also be present as is known to those of ordinary skill in the art. For example, if the various compartments of the cell are prefabricated separately from stainless steel, such gaskets would typically be placed between those portions of the prefabricated compartments that would otherwise abut each other when the electrolytic cell is assembled. Such nonconductive gaskets may be fabricated from synthetic polymeric materials, e.g., copolymers of ethylene and propylene, and fluorinated polymers.

Cathode 28 and current collecting electrode 19 each may be fabricated from any appropriate material that is at least both corrosion resistant to the environments to which they are exposed and electrically conductive. In electrolytic cells 2, 4 and 6, it is also desirable that cathode 28 and current collecting electrode 19 be substantially rigid so as to provide support for, respectively, anion exchange membrane 31, and either hydrogen consuming gas diffusion anode 22 alone or the combination of hydrogen consuming gas diffusion anode 22 and hydraulic barrier 25. Materials from which cathode 28 and current collecting electrode 19 may be fabricated include, but are not limited to: graphite; platinum; titanium coated with platinum; titanium coated with an oxide of ruthenium; nickel; stainless steel; specialty steels including high alloy steels containing nickel, chromium, and molybdenum, e.g., HASTELLOY® C-2000™ alloy and HASTELLOY® C-276™ alloy from Haynes International, Inc. While current collecting electrode 19 may be fabricated from stainless steel, it is preferred to use a more corrosion resistant material such as a high alloy steel, e.g., HASTELLOY® C-2000™ alloy. Cathode 28 and current collecting electrode 19 may each comprise a material selected from the group consisting of graphite, platinum, titanium coated with platinum, titanium coated with an oxide of ruthenium, nickel, stainless steel, high alloy steel and appropriate combinations of such materials.

Preferably both cathode 28 and current collecting electrode 19 have a perforated or mesh-like configuration. A perforated or mesh-like configuration provides for increased cathode and electrode surface area, and minimizes interference with the movement of ions across the anion exchange membrane, the hydrogen consuming gas diffusion anode and also the hydraulic barrier.

The anion exchange membrane 31 used in the practice of the present invention can be prepared from any appropriate material that is permeable to and capable of transferring anions. Typically, such anion exchange membranes are fabricated from commercially available organic polymers, often thermoplastic polymers, containing weakly basic pendant polar groups. The membranes may comprise polymers based on fluorocarbons, polystyrene, polypropylene, polybutadiene, polyisoprene, polyisobutylene, polyethylene and hydrogenated styrene/butadiene block copolymers. For example, one such representative anion exchange membrane comprises polystyrene which has dialkylamino groups that have been converted into quaternary ammonium ions covalently bonded to at least some of the benzene rings of the polystyrene backbone. It is preferable that the anion exchange membrane also be physically durable and stable towards exposure to acids, in particular hydrogen halides, e.g., hydrogen chloride.

A particular example of an anion exchange membrane used in the practice of the present invention is a copolymer of styrene and divinylbenzene which contains from 4 percent (%) to 16%, typically from 6% to 8%, by weight of divinylbenzene and also quaternary ammonium groups as anion carriers. Such membranes are available commercially under the trade designation RAIPORE® from RAI Research Corporation, and TOSFLEX® from Tosoh Corporation. Other suitable membranes include, but are not limited to: NEOSEPTA® membranes from Tokyuama Soda; SELEMION membranes from Asahi Glass; and IONAC MA 3148, MA 3236 and MA 3457 membranes (based on a polymer of heterogeneous polyvinyl chloride substituted with quaternary ammonium groups) from Ritter-Pfaulder Corporation. Particularly preferred anion exchange membranes are NEOSEPTA® ACM and NEOSEPTA® AHA-2 membranes, available commercially from Tokuyama Soda of Japan, which are described as comprising a copolymer of styrene and divinylbenzene having pendent quaternary ammonium groups.

When the practice of the method of the present invention includes the use of electrolytic cell 4, it is preferred that hydraulic barrier 25 prevent substantially the flow of liquid and hydrogen gas between intermediate compartment 16 and anode compartment 10, while also being permeable to hydrogen cations. Hydraulic barrier 25 may be, for example, a cation exchange membrane or a microporous film.

When hydraulic barrier 25 is a cation exchange membrane, it may be fabricated of any appropriate material that is also capable of transporting cations. Examples of classes of materials from which such cation exchange membrane may be fabricated include, but are not limited to, organic polymers, in particular synthetic organic polymers, and ceramics, e.g., beta-alumina. The use of synthetic organic polymers having pendent acidic groups is preferred, many of which are commercially available or can be made according to art-recognized methods. A preferred class of synthetic organic polymers are fluoropolymers, more preferably perfluoropolymers, and in particular copolymers prepared from of two or more fluoromonomers or perfluoromonomers having pendent acid groups, preferably pendent sulfonic acid groups.

When the cation exchange membrane is fabricated from fluorinated polymer(s) or copolymer(s), the pendent acid groups may include the following representative general formulas: $—CF_2CF(R)SO_3H$; and $—OCF_2CF_2CF_2SO_3H$, where R is a F, Cl, $CF_2Cl$, or a $C_1$ to $C_{10}$ perfluoroalkyl radical. The synthetic organic polymer of the cation exchange membrane may, for example, be a copolymer of ethylene and a perfluorinated monomer as represented by the following general formula, $CF_2{=}CFOCF_2CF(CF_3)OCF_2CF_2SO_3H$. These copolymers may have pendent sulfonyl fluoride groups ($—SO_2F$), rather than pendent sulfonic acid groups ($—SO_3H$). The sulfonyl fluoride groups ($—SO_2F$) can be reacted with potassium hydroxide to form $—SO_3K$ groups, which can then be reacted with an acid to form sulfonic acid groups $—SO_3H$.

Suitable cation exchange membranes comprised of copolymers of polytetrafluoroethylene and poly(vinyl ether) containing pendant sulfonic acid groups are offered by E.I. du Pont de Nemours and Company under the trademark "NAFION" (hereinafter referred to as NAFION®). In particular, NAFION® membranes containing pendant sulfonic acid groups include NAFION® 117, NAFION® 324, NAFION® 417 and NAFION® 430 membranes. The NAFION® 117 membrane is described as an unsupported membrane having an equivalent weight of 1100 grams per equivalent (g/eq), equivalent weight being here defined as that amount of resin required to neutralize one liter of a 1 Molar (M) sodium hydroxide solution. The NAFION® 324, NAFION® 417 and NAFION® 430 membranes are described as being supported on a fluorocarbon fabric. The NAFION® 417 membrane has an equivalent weight of 1100 g/eq. The NAFION® 324 membrane is described as having a two-layer structure comprised of: a 125 micrometer ($\mu$m) thick membrane having an equivalent weight of 1100 g/eq; and a 25 $\mu$m thick membrane having an equivalent weight of 1500 g/eq.

While the use of cation exchange membranes based on synthetic organic polymers are preferred as hydraulic barriers, it is within the scope of the practice of the method of the present invention to use other cation-transporting membranes which are not polymeric. For example, solid state proton conducting ceramics such as beta-alumina may be used. Examples of representative solid proton conductors that may be used are listed in columns 6 and 7 of U.S. Pat. No. 5,411,641, which disclosure is incorporated herein by reference.

Hydraulic barrier 25 may also be a microporous film. Microporous films are known and can be described as being heterogeneous structures having a solid phase containing voids. Microporous films useful in the present invention are preferably permeable to hydrogen cations and prevent substantially the flow of liquid and hydrogen gas between intermediate compartment 16 and anode compartment 10. Suitable microporous films may comprise synthetic organic polymers such as polypropylene or polysulfone. An example of a commercially available microporous film useful in the practice of the method of the present invention is available under the trademark CELGARD® from Hoechst-Celanese Corp.

Hydrogen consuming gas diffusion anode 22 may be fabricated from any suitable material or combination of materials which provides an electrochemically active surface upon which hydrogen gas ($H_2$) can be converted to hydrogen cation ($H^+$), through which hydrogen cations may diffuse, and which is also semihydrophobic. By semihydrophobic is meant that an aqueous liquid can penetrate the anode without flooding it, i.e., without preventing the electrochemical conversion of hydrogen gas to hydrogen cation. The electrochemical activity is typically provided by a catalytic material. Examples of suitable catalytic materials include, but are not limited to, platinum, ruthenium, osmium, rhenium, rhodium, iridium, palladium, tungsten carbide, gold, titanium, zirconium, alloys of these with non-noble metals and appropriate combinations thereof.

The hydrogen consuming gas diffusion anode 22 used in the practice of the present invention preferably comprises platinum, e.g., platinum supported on carbon, preferably hydrophilic carbon black, or finely powdered platinum (platinum black), which has been dispersed in a polymer matrix. Examples of useful polymer matrices include fluorinated and perfluorinated polymers. A preferred polymer in which platinum supported on hydrophilic carbon black may be dispersed is polytetrafluoroethylene. The hydrogen consuming gas diffusion anode 22 may comprise from 0.1 milligrams platinum per square centimeter of the surface area of the hydrogen consuming gas diffusion anode ($mg/cm^2$) to 15 $mg/cm^2$, preferably from 0.5 $mg/cm^2$ to 10 $mg/cm^2$, and more preferably from 0.5 $mg/cm^2$ to 6 $mg/cm^2$.

Within the anode compartment, the method by which the anode assembly is held together may be achieved by any appropriate means. Such methods include, but are not limited to: maintaining a higher internal pressure within intermediate compartment 16 relative to catholyte compartment 13 and anode compartment 10; clamping components, 25, 22 and 19, or 22 and 19 together; providing a biasing element within at least the intermediate compartment, e.g., an electrically nonconductive plastic spring, not shown, can be placed within intermediate compartment 16 such that it is in biased contact with anion exchange membrane 31 and either hydraulic barrier 25 or hydrogen consuming gas diffusion anode 22; and combinations of these methods.

In one embodiment of the present invention hydrogen consuming gas diffusion anode 22 is hot-pressed onto one side of hydraulic barrier 25. In another embodiment of the present invention, hydrogen consuming gas diffusion anode 22 is simply placed between hydraulic barrier 25 and current collecting electrode 19 prior to assembly of the electrolytic cell. In yet another embodiment of the present invention, carbon cloth or carbon paper, not shown, is placed between hydrogen consuming gas diffusion anode 22 and current collecting electrode 19 to provide additional support for the hydrogen consuming gas diffusion anode. The carbon cloth and carbon paper are both preferably semihydrophobic, e.g., treated with TEFLON® polytetrafluoroethylene prior to use. Optionally, the carbon cloth and carbon paper may also be impregnated with a catalytic material, such as platinum.

Ensuring that electrical contact exists between hydrogen consuming gas diffusion anode 22 and electrode 19 is important in the practice of the present invention. This is the case when the anode assembly comprises either (a) the hydrogen consuming gas diffusion anode 22 fixedly held between hydraulic barrier 25 and current collecting electrode 19, or (b) the hydrogen consuming gas diffusion anode 22 and current collecting electrode 19. In one embodiment of the present invention, electrical contact is maintained between the hydrogen consuming gas diffusion anode 22 and the current collecting electrode 19 by ensuring that a positive internal pressure difference exists between at least the intermediate and anode compartments. By positive internal pressure difference is here meant that intermediate compartment 16 has an internal pressure greater than that of anode compartment 10. In this case, the positive internal pressure difference value is determined by subtracting the internal pressure of anode compartment 10 from that of intermediate compartment 16. While the practice of the present invention allows for the internal pressure difference between intermediate compartment 16 and catholyte compartment 13 to be essentially zero, it is preferable that the intermediate compartment 16 have an internal pressure greater than that of catholyte compartment 13.

The upper limit of the positive internal pressure difference between the intermediate compartment and each of the catholyte and anode compartments will depend on a number of factors including, for example, the maximum pressure that the anion exchange membrane, hydraulic barrier, and hydrogen consuming gas diffusion anode can each endure before they burst. In the practice of the method of the present invention, the positive internal pressure difference between the intermediate compartment and each of catholyte and anode compartments typically has a minimum value of at least 0.07 Kilograms per square centimeter ($Kg/cm^2$) (1 pound per square inch (psi)), preferably at least 0.14 $Kg/cm^2$ (2 psi), and more preferably at least 0.21 $Kg/cm^2$ (3 psi). The positive internal pressure difference between the intermediate compartment and each of catholyte and anode compartments will also typically have a maximum value of less than 1.40 $Kg/cm^2$ (20 psi), preferably less than 0.70 $Kg/cm^2$ (10 psi) and more preferably less than 0.49 $Kg/cm^2$ (7 psi). In the practice of the method of the present invention, the positive internal pressure difference between the intermediate compartment and each of catholyte and anode compartments may range between any combination of these minimum and maximum values, inclusive of the recited values.

The present invention relates to a method of electrochemically preparing epoxides from α-halohydrin. As used herein and in the claims, by the term "α-halohydrin" is meant a hydroxy or polyhydroxy functional organic species having at least one halo group covalently bonded to an $sp^3$ hybridized carbon atom, which is in a position alpha to at least one $sp^3$ hybridized carbon atom having a hydroxy group covalently bonded thereto, e.g., 1-chloro-2-hydroxypropane and 1,3-dichloro-2-hydroxypropane. Further, as used herein and in the claims, by the term "epoxide" is meant an organic compound containing one or more three membered cyclic ether groups, e.g., alkylene oxides and epihalohydrins.

The halo of the α-halohydrin is selected from the group consisting of chloro, bromo and iodo. The backbone of the α-halohydrin may be a straight or branched chain alkane having from 2 to 20 carbon atoms, preferably from 2 to 12 carbon atoms, and more preferably from 2 to 6 carbon atoms, e.g., ethane, propane, butane, isobutane, pentane, isopentane, hexane, octane, dodecane and octadecane, or a cyclic alkane having from 5 to 12 carbon atoms, e.g., cyclopentane, cyclohexane, cyclooctane and cyclododecane. Further, the α-halohydrin may have: aryl substituents, e.g., phenyl, cumenyl, mesityl, tolyl and xylyl substituents; ethylenic unsaturated substituents; and halogen, oxygen and sulfur-containing substituents, e.g., hydroxyl, thiol, carboxylic acid, ester, ether and thioether substituents.

The α-halohydrins useful in the present invention may be prepared by art-recognized methods, exemplary of which is the reaction of a hypohalous acid, e.g., hypochlorous acid, hypobromous acid or hypoiodous acid, with an olefin, e.g., ethene, propene, 1-butene, 2-butene, 1,3-butadiene, 9,10-octadecanoic acid, esters of 9,10-octadecanoic acid, 9,12-octadecadienoic acid, esters of 9,12-octadecadienoic acid, cyclopentene, vinylcyclopentane, cyclohexene, 1,4-cyclohexadiene, vinylcyclohexane, divinylcyclohexane, styrene and divinylbenzene. The reaction of hypohalous acid with olefin will also typically result in the co-product formation of aqueous hydrogen halide, e.g., hydrogen chloride, hydrogen bromide or hydrogen iodide. The aqueous hydrogen halide co-product will generally be present in an amount of less than 3% by weight, for example, less than 2% by weight, based on the total weight of the aqueous solution comprising α-halohydrin.

Representative α-halohydrins useful in the present invention include, but are not limited to, 2-chloro-1-hydroxyethane, 2-bromo-1-hydroxyethane, 1-chloro-2-hydroxypropane, 1-iodo-2-hydroxypropane, 2-chloro-1-hydroxypropane, 1,3-dichloro-2-hydroxypropane, 2,3-dichloro-1-hydroxypropane, 1,3-dibromo-2-hydroxypropane, 2,3-dibromo-1-hydroxypropane, 3-chloro-1,2-dihydroxypropane, α-chlorohydroxybutane, e.g., 1-chloro-2-hydroxybutane, 1,4-dichloro-2,3-dihydroxybutane, 1-chloro-2-hydroxycyclopentane, (α-chloro-hydroxyethyl)cyclopentane, 1-chloro-2-hydroxycyclohexane, (α-chloro-hydroxyethyl)cyclohexane, bis(α-chloro-hydroxyethyl)cyclohexane, e.g., 1,2-, 1,3- and 1,4-bis(1-chloro-2-hydroxyethyl)cyclohexane, (α-chloro-hydroxyethyl)benzene and bis(α-chloro-hydroxyethyl) benzene, e.g., 1,2-, 1,3- and 1,4-bis(1-chloro-2-hydroxyethyl)benzene. In a preferred embodiment of the present invention, the (α-halohydrin is selected from the group consisting of 1-chloro-2-hydroxypropane, 2-chloro-1-hydroxypropane, 1,3-dichloro-2-hydroxypropane, 1,3-dibromo-2-hydroxypropane and mixtures thereof.

When the α-halohydrin contains more than three carbon atoms, its solubility in the aqueous solution circulated through catholyte compartment 13 will be reduced and the rate at which it is converted to an epoxide will also be reduced. Accordingly, to improve the solubility of the α-halohydrin, a co-solvent may also be present in the circulated aqueous solution. Examples of cosolvents suitable for use in aqueous solutions include, but are not limited to: hydroxy functional ethers of ethylene glycol, e.g., butyl 2-hydroxyethyl ether and hexyl 2-hydroxyethyl ether; and hydroxy functional ethers of 1,2-dihydroxy propane, e.g., methyl 2-hydroxypropyl ether and phenyl 2-hydroxypropyl ether. If used, cosolvents are generally present in amounts of less than 10 percent by weight, e.g., less than 5 percent by weight, based on total weight of the aqueous solution circulated through catholyte compartment 13.

Representative epoxides that may be prepared in accordance with the method of the present invention include, but are not limited to, ethylene oxide, propylene oxide, 1-chloro-2,3-epoxypropane (epichlorohydrin), 1-bromo-2,3-epoxypropane (epibromohydrin), 1-hydroxy-2,3-epoxypropane, 1,2-epoxybutane, 2,3-epoxybutane, 1,2,3,4-diepoxybutane, 1,2-epoxypentane, 1,2-epoxyhexane, 1,2-epoxyoctane, 1,2,7,8-diepoxyoctane, 1,2-epoxydecane, 1,2-epoxydodecane, 6-oxabicyclo[3.1.0]hexane, 7-oxabicyclo[4.1.0]heptane, 3-epoxyethyl-7-oxabicyclo[4.1.0]heptane, 7-oxabicyclo[4.1.0]heptan-2-one, 3,4-epoxycyclohexylmethyl 3,4-epoxycyclohexanecarboxylate, exo-2,3-epoxynorborane, 9-oxabicyclo[6.1.0]nonane, 1,2,5,6-diepoxycyclooctane, 1,2-epoxycyclododecane, 1,2-epoxyethylbenzene, 2,3-(epoxypropyl)benzene, 1,2-epoxy-3-phenoxypropane and 2,3-epoxypropyl 4-methoxyphenyl ether.

The operation of electrolytic cells 2 and 4 of FIGS. 2 and 3 will now be described as related to preferred embodiments of the process of the present invention. An aqueous solution comprising α-halohydrin, e.g., 1-chloro-2-hydroxypropane, is circulated through catholyte compartment 13 by forwarding the solution from a source of α-halohydrin, e.g., temperature controlled reservoir 76 shown in FIGS. 2 and 3, through a suitable conduit (shown by line 64) into catholyte compartment 13 through inlet 46; withdrawing a process stream comprising epoxide, e.g., an alkylene oxide such as propylene oxide, and α-halohydrin from catholyte compartment 13 through outlet 49; and forwarding that process stream by a suitable conduit (shown by line 67) to the source of α-halohydrin, e.g., reservoir 76.

The temperature at which the aqueous solution comprising α-halohydrin is maintained depends on, for example, its boiling point and the operating temperature limits of anion exchange membrane 31. In the practice of the present invention, the aqueous solution comprising α-halohydrin is typically maintained at a minimum temperature of at least 15° C., preferably at least 20° C., and more preferably at least 25° C. The aqueous solution comprising α-halohydrin is also typically maintained at a maximum temperature of less than 40° C., preferably less than 35° C., and more preferably less than 30° C. The temperature at which the aqueous solution comprising α-halohydrin is maintained may range between any combination of these minimum and maximum temperature values, inclusive of the recited values.

The aqueous solution comprising α-halohydrin typically contains α-halohydrin in an amount of at least 1% by weight, preferably at least 2% by weight, and more preferably at least 3% by weight, based on the total weight of the aqueous solution comprising α-halohydrin. The α-halohydrin is also typically present in an amount of not more than 30% by weight, preferably not more than 15% by weight, and more preferably not more than 10% by weight, based on the total weight of the aqueous solution comprising α-halohydrin. The amount of α-halohydrin present in the aqueous solution comprising α-halohydrin may range between any combination of these amounts, inclusive of the recited amounts.

The aqueous solution comprising α-halohydrin may optionally contain an electrical conductivity enhancing additive, e.g., a salt. Examples of suitable salts include, but are not limited to, an alkali metal halide, e.g., lithium chloride, sodium chloride, sodium bromide, sodium iodide, potassium chloride, potassium bromide and potassium iodide; and an alkaline earth metal halide, e.g., magnesium chloride and calcium chloride. If used, the salt is typically present in the aqueous solution comprising α-halohydrin in an amount of at least 0.05% by weight, preferably at least 0.1% by weight, and more preferably at least 0.5% by weight, based on the total weight of the aqueous solution comprising α-halohydrin. The salt may also be present in an amount of not more than 10% by weight, preferably not more than 5% by weight, and more preferably not more than 3% by weight, based on the total weight of the aqueous solution comprising α-halohydrin. The amount of salt present in the aqueous solution comprising α-halohydrin may range between any combination of these amounts, inclusive of the recited amounts.

Similarly and simultaneously with the circulation of aqueous solution comprising α-halohydrin through catholyte compartment 13, in connection with electrolytic cell 4, hydrogen gas is circulated through anode compartment 10 by forwarding hydrogen gas from a source of hydrogen, e.g., reservoir 73 shown in FIGS. 2 and 3, through a suitable conduit or transfer line (shown by line 52) into anode compartment 10 through inlet 34; withdrawing hydrogen gas from anode compartment 10 through outlet 37; and forwarding withdrawn hydrogen gas by a suitable conduit or transfer line (shown by line 55) to the source of hydrogen, e.g., reservoir 73. Other gas(es) may be present with the hydrogen gas circulated through anode compartment 10, e.g., nitrogen, as long as such other gas(es) do not adversely affect the operation of the electrolytic cell. In particular, it is preferred that the hydrogen gas-containing stream be substantially free of carbon monoxide (CO) as carbon monoxide can poison or otherwise degrade the hydrogen consuming gas diffusion anode 22.

Contemporaneously and in a manner similar to the circulation of the respective process streams through each of the catholyte and anode compartments, an aqueous conductive electrolyte solution is circulated through intermediate compartment 16 by forwarding the electrolyte solution from a source of electrolyte solution, e.g., temperature controlled reservoir 79 shown in FIGS. 2 and 3, through a suitable conduit (shown by line 58) into intermediate compartment 16 through inlet 40; withdrawing a process stream comprising the electrolyte solution from intermediate compartment 16 through outlet 43; and forwarding that process stream by suitable conduits (shown by line 61 in FIG. 3) to the source of electrolyte solution, e.g., reservoir 79.

The aqueous conductive electrolyte solution circulated through intermediate compartment 16 is a solution capable of conducting an electric current. The temperature at which the aqueous conductive electrolyte solution is maintained depends on, for example, its boiling point and the operating temperature limits of anion exchange membrane 31 and hydraulic barrier 25 and/or hydrogen consuming gas diffusion anode 22. In the practice of the present invention, the aqueous conductive electrolyte solution is typically maintained at a temperature of at least 25° C., preferably at least 30° C., and more preferably at least 40° C. The aqueous conductive electrolyte solution is also typically maintained at a temperature of less than 70° C., preferably less than 65° C., and more preferably less than 60° C. The temperature at which the aqueous conductive electrolyte solution is maintained may range between any combination of these temperatures, inclusive of the recited temperatures.

The aqueous conductive electrolyte solution may have present therein hydrogen halide, e.g., hydrogen chloride, and/or an alkali metal halide, e.g., sodium chloride, the halide being preferably the same as that of the α-halohydrin. In the method of the present invention, the aqueous hydrogen halide conductive electrolyte solution typically has a hydrogen halide concentration of at least 1% by weight, preferably at least 5% by weight, and more preferably at least 10% by weight, based on the total weight of the aqueous conductive electrolyte solution. The concentration of hydrogen halide in the aqueous hydrogen halide conductive electrolyte solution is also typically less than 25% by weight, preferably less than 20% by weight, and more preferably less than 15% by weight, based on the total weight of the aqueous conductive electrolyte solution. The concentration of hydrogen halide present in the aqueous conductive electrolyte solution may range between any of these values, inclusive of the recited values. In a preferred embodiment of the present invention, the aqueous conductive electrolyte solution comprises an aqueous solution of hydrogen chloride.

In a preferred embodiment of the present invention, the aqueous conductive electrolyte solution circulated through intermediate compartment 16 of electrolytic cells 2 and 4 has present therein an amine, i.e., an organic amine. The amine enhances the operating efficiency of the electrolytic cell by minimizing the build-up of hydrogen halide within the intermediate compartment through formation of an electrically conductive amine hydrohalide salt therewith. Using a separate electrolytic cell, the amine hydrohalide salt can be electrochemically converted to free amine, which can then be re-introduced into intermediate compartment 16, as will be described in further detail below. The amine is typically present in the aqueous conductive electrolyte solution in an amount of at least 1% by weight, preferably at least 2% by weight, and more preferably at least 3% by weight, based on the total weight of the aqueous conductive electrolyte solution. The amine may also be present in the aqueous conductive electrolyte solution in an amount of no greater than 30% by weight, preferable no greater than 15% by weight, and more preferably no greater than 10% by weight, based on the total weight of the aqueous conductive electrolyte solution. The amount of amine present in the aqueous conductive electrolyte solution may range between any combination of these values, inclusive of the recited values.

Examples of amines that may be present in the aqueous conductive electrolyte solution circulated through intermediate compartment 16 of electrolytic cells 2 and 4 include, but are not limited to: ammonia; mono alkyl, e.g., $C_1$–$C_{12}$ alkyl, amines, di- and tri-substituted alkyl, e.g., $C_1$–$C_{12}$ alkyl, amines, in which the alkyl groups may be the same or different, saturated or unsaturated, examples of saturated alkyl groups include, but are not limited to, methyl, ethyl, isopropyl, n-butyl, tert-butyl, amyl and dodecyl, examples of unsaturated alkyl groups, include, but are not limited to, allyl and methallyl; one or more amines belonging to the family of ethyleneamines, including, ethylenediamine (EDA), diethylenetriamine (DETA), triethylenetetramine (TETA), tetraethylenepentamine (TEPA), pentaethylenehexamine (PEHA), piperazine (DEDA), and 1-(2-aminoethyl) piperazine; alkyl, e.g., $C_1$–$C_2$ alkyl, ethylenediamines, e.g., N-ethylethylenediamine, N,N-dimethylethylenediamine, N,N'-dimethylethylenediamine, N,N-diethylethylenediamine, N,N'-diethylethylenediamine, N,N-dimethyl-N'-ethylethylenediamine, and N,N,N',N'-tetramethylethylenediamine; propylenediamines, e.g., 1,2-propylenediamine, and 1,3-propylenediamine; alkyl, e.g., $C_1$–$C_3$ alkyl, propylenediamines, e.g., N-methyl-1,3-propylenediamine; alkanolamines, e.g., mono-, di- and tri (2-hydroxyethyl)amine; alkylamino alkanols, e.g., $C_1$–$C_6$ alkylamino $C_1$–$C_{12}$ alkanols, e.g., 2-(ethylamino)ethanol, and 2-(diethylamino)ethanol; $C_5$–$C_7$ cycloaliphatic amines, e.g., cyclohexylamine, N-methylcyclohexylamine, and 1,4-diazobicyclo[2.2.2]octane; and aromatic amines, e.g., aniline, N-ethylaniline, and N,N-diethylaniline.

As used herein, the term "ethyleneamine" is meant to refer to one or mixtures of amines belonging to the family of thyleneamines as previously recited. In a preferred embodiment of the present invention, the amine is selected from the group consisting of ammonia, monoalkylamines, dialkylamines, trialkylamines, ethyleneamines, alkyl ethylenediamines, propylenediamines, alkyl propylenediamines, monoalkanolamines, dialkanolamines, trialkanolamines, cycloaliphatic amines, aromatic amines, and mixtures of such amines, as described previously. In a particularly preferred embodiment of the present invention, the amine is an "ethyleneamine" and is selected from the group consisting of ethylenediamine, diethylenetriamine, triethylenetetramine, tetraethylenepentamine, pentaethylenehexamine, piperazine, 1-(2-aminoethyl) piperazine and mixtures of such ethyleneamines.

Electrolytic cells 2, 4 and 6 may be operated at a current density of at least 0.05 Kiloamperes per square meter of electrode surface available for electrochemical reaction (Kamps/$m^2$), preferably at least 0.1 Kamps/$m^2$, and more preferably at least 0.2 Kamps/$m^2$. The current density also may be not more than 10 Kamps/$m^2$, preferably not more than 7 Kamps/$m^2$, and more preferably not more than 6 Kamps/$m^2$. In the practice of the method of the present invention, the current density may range between any combination of these values, inclusive of the recited values. The surface area of the electrode being here calculated from its perimeter dimensions alone.

While not meaning to be bound by any theory, it is believed from the evidence at hand that the current passing through electrolytic cells 2 and 4 results in chemical and electrochemical reactions that are hereinafter described. The electrochemical and chemical reactions believed to occur within catholyte compartment 13 may be represented by the following General Scheme I:

General Scheme I $$H_2O + e^- \xrightarrow{\text{Electrical Energy}} 1/2\,(H_{2(g)}) + OH^-$$

$$OH^- + \text{alpha-halohydrin} \longrightarrow \text{epoxide} + H_2O + X^-\,(aq)$$

wherein $X^-$ represents a halide anion. The halide anion $X^-$ is selectively transported across anion exchange membrane 31 and passes into intermediate compartment 16. The electrons consumed, as shown in General Scheme I, are provided by cathode 28. Hydrogen gas generated within the catholyte compartment is forwarded along with the circulating α-halohydrin/epoxide process stream to α-halohydrin reservoir 76 from where it may be recovered by means of conduit 99, as shown in FIGS. 2 and 3. Alternatively, the hydrogen gas removed from reservoir 76 may be forwarded to reservoir 73 by means of a conduit not shown.

Within anode compartment 10, the following electrochemical reaction is believed to occur as represented by General Scheme II:

General Scheme II $$1/2\ (H_{2(g)}) \xrightarrow{\text{Electrical Energy}} H^+ + e^-$$

In the case of electrolytic cell 4, hydrogen cations ($H^+$) produced within and/or on the surface of anode 22 move across hydraulic barrier 25 and pass into intermediate compartment 16. In the case of electrolytic cell 2 of FIG. 1, the hydrogen cations diffuse directly through hydrogen consuming gas diffusion anode 22 into intermediate compartment 16. The electrons generated, as shown in General Scheme II, are transferred by electrical contact from hydrogen consuming gas diffusion anode 22 to current collecting electrode 19. Within intermediate compartment 16, the halide anions ($X^-$) transported across anion exchange membrane 31, and the hydrogen cations ($H^+$) from anode compartment 10, together form hydrogen halide which dissolves in the aqueous conductive electrolyte solution to form aqueous hydrogen halide. If free amine, e.g., ethylene diamine, is circulated through intermediate compartment 16 of electrolytic cells 2 and 4, then an amine hydrohalide is formed in the presence of aqueous hydrogen halide.

During the operation of either of electrolytic cells 2 or 4, the concentration of epoxide within the circulating aqueous solution of α-halohydrin increases with each pass through catholyte compartment 13. The process stream withdrawn from catholyte compartment 13 will contain a higher amount of epoxide than the process stream entering catholyte compartment 13.

When the concentration of epoxide in the process stream circulating through catholyte compartment 13 reaches a desired level, the epoxide is recovered from that stream. Of the total molar equivalents of α-halohydrin initially present in the aqueous solution of α-halohydrin circulated through catholyte compartment 13, at least 50%, preferably at least 80%, more preferably at least 99%, and particularly preferably 100% of these equivalents are converted to epoxide in accordance with the practice of the method of the present invention.

Epoxide produced according to the present invention may be recovered, i.e., isolated, from the aqueous solution removed from catholyte compartment 13 by methods that are known to those of ordinary skill in the art. Such art-recognized recovery methods include, but are not limited to, steam distillation and vacuum distillation.

While a batch process has been described, a continuous process for converting the α-halohydrin to epoxide is contemplated. For example, a side stream of the circulating aqueous stream of α-halohydrin can be removed to make the process a continuous or semi-continuous process.

In the embodiment of the present invention represented by FIG. 3, an aqueous solution comprising amine hydrohalide is removed from intermediate compartment 16 of electrolytic cell 4 and circulated through catholyte compartment 13' of electrolytic cell 6. The electrochemical and chemical reactions believed to occur within catholyte compartment 13' are represented by the following General Scheme III:

General Scheme III $$H_2O + e^- \xrightarrow{\text{Electrical Energy}} 1/2\ (H_{2(g)}) + OH^-$$

$$BH^+X^- + OH^- \longrightarrow B + H_2O + X^-$$

wherein $BH^+X^-$ represents an amine hydrohalide, $X^-$ represents a halide anion, and B represents free amine. The halide anion $X^-$ is selectively transported across anion exchange membrane 31 and passes into intermediate compartment 16'. The electrons consumed, as shown in General Scheme III, are provided by cathode 28. Hydrogen gas generated within the catholyte compartment is forwarded along with the circulating amine hydrohalide/free amine process stream to amine hydrohalide reservoir 106 through a suitable conduit (shown by line 142) from where it may be recovered by means of a conduit (shown by line 145), as shown in FIG. 3. Alternatively, the hydrogen gas removed from reservoir 106 may be forwarded to reservoir 103 by means of a conduit not shown in FIG. 3.

Hydrogen gas is circulated through anode compartment 10' of electrolytic cell 6, and the electrochemical reaction as represented by General Scheme II is believed to occur therein. Within intermediate compartment 16', the halide anions ($X^-$) transported across anion exchange membrane 31 and the hydrogen cations ($H^+$) from anode compartment 10' together form hydrogen halide which dissolves in an aqueous conductive electrolyte solution circulated therethrough to form aqueous hydrogen halide.

In the practice of the method of the present invention, each pass of the aqueous conductive electrolyte solution through intermediate compartment 16 will result in an increase in the concentration of hydrogen halide within the process stream. If amine, e.g., ethylene diamine, is present in the process stream, then the ratio of the molar equivalents of amine hydrohalide to the total molar equivalents of primary amine groups originally present, i.e., the "amine conversion ratio", will increase approaching unity. When the amine conversion ratio equals unity, the hydrogen halide concentration within the process stream circulating through intermediate compartment 16 will begin to increase with continued operation of the cell. If the concentration of hydrogen halide within the intermediate compartment becomes too high, e.g., in excess of 25% by weight, based on the total weight of the aqueous conductive electrolyte solution, the operating efficiency of the electrolytic cell will likely begin to degrade. Examples of degraded operating efficiency include, higher required operating cell potentials and reduced current efficiency resulting from the back migration of protons and halide anions across anion exchange membrane 31.

When the process stream circulated through intermediate compartment 16 contains amine, the method of the present invention may further comprise the step of maintaining the amine hydrohalide level therein below designated threshold limits, e.g., maintaining the amine conversion ratio at a value of less than 1.0, preferably less than 0.75 and more preferably less than 0.5. FIG. 3 represents an embodiment of the present invention wherein the aqueous conductive electrolyte solution circulated through intermediate compartment 16 of electrolytic cell 4 contains amine, and the amine hydrohalide level within this process stream is maintained below the previously recited threshold limits by circulating at least a portion of it through catholyte compartment 13' of electrolytic cell 6. Electrolytic cell 6 operates to electrolytically convert amine hydrohalide to free amine, which can then be re-introduced into the process stream circulating through intermediate compartment 16 of electrolytic cell 4.

Referring to FIG. 3, an aqueous process stream comprising amine and amine hydrohalide is withdrawn from intermediate compartment 16 of electrolytic cell 4 through outlet 43, and is forwarded to reservoir 79 by means of a suitable conduit (shown by line 61). A portion of the contents of reservoir 79 may be introduced continuously or periodically into catholyte compartment 13' of electrolytic cell 6 by: removing a bleed stream from reservoir 79 through a suitable conduit (shown by line 121); forwarding this bleed stream through valve 124; and introducing the bleed stream into catholyte compartment 13' through inlet 47 by means of a suitable conduit (shown by line 127). This process stream, comprising amine and amine hydrohalide, is circulated through catholyte compartment 13' by withdrawing it through outlet 50 and forwarding it to reservoir 106 by means of a suitable conduit (shown by line 142); withdrawing the process stream from reservoir 106 through a suitable conduit (shown by line 130); and introducing the stream back into catholyte compartment 13' through inlet 47 by means of conduit 127.

Simultaneously with the circulation of aqueous solution of amine and amine hydrohalide through catholyte compartment 13', hydrogen gas is circulated through anode compartment 10' of electrolytic cell 6 by forwarding hydrogen gas from a source of hydrogen, e.g., reservoir 103 shown in FIG. 3, through a suitable conduit or transfer line (shown by line 115); introducing such hydrogen gas into anode compartment 10' through inlet 35; withdrawing hydrogen gas from anode compartment 10' through outlet 38; and forwarding withdrawn hydrogen gas by a suitable conduit or transfer line (shown by line 112) to the source of hydrogen, e.g., reservoir 103.

Contemporaneously and in a manner similar to the circulation of the respective process streams through each of the catholyte and anode compartments of electrolytic cell 6, a second aqueous conductive electrolyte solution is circulated through intermediate compartment 16' by forwarding the second electrolyte solution from a source of second electrolyte solution, e.g., temperature controlled reservoir 100 shown in FIG. 3, through a suitable conduit (shown by line 118); introducing the second electrolyte solution into intermediate compartment 16' through inlet 41; withdrawing a process stream comprising the second electrolyte solution from intermediate compartment 16' through outlet 44; and forwarding that process stream by a suitable conduit (shown by line 109) to the source of electrolyte solution, e.g., reservoir 100. The second aqueous conductive electrolyte solution circulated through intermediate compartment 16' contains hydrogen halide, e.g., hydrogen chloride, present in an amount within the ranges previously recited with regard to the aqueous conductive electrolyte solution circulated through intermediate compartment 16 of electrolytic cells 2 and 4.

Electrolytic cell 6 is typically operated until 95% to 99.5%, and preferably 98% to 99.5% of the total mole equivalents of amine hydrohalide initially present in the aqueous solution of amine hydrohalide introduced into catholyte compartment 13' are converted to free amine. When this level of conversion has been achieved, a portion of the process stream circulating through catholyte compartment 13' of electrolytic cell 6 may be introduced into the process stream circulating through intermediate compartment 16 of electrolytic cell 4 by: removing a portion of the process stream circulating through catholyte compartment 13' from reservoir 106 by means of a suitable conduit (shown by line 139); passing this process stream through valve 136, and introducing it into reservoir 79 through a suitable conduit (shown by line 133). If desired, the operation of valves 124 and 136 may be coordinated in a manner such that equivalent solution volumes are both removed from and introduced into reservoir 79 either simultaneously, serially or continuously.

When the aqueous conductive electrolyte solution circulated through intermediate compartment 16 comprises hydrogen halide, e.g., hydrogen chloride, and is substantially free of amine, the operation of the electrolytic cell, e.g., electrolytic cell 4, will result in an increase in the concentration of hydrogen halide within this solution with each pass through the intermediate compartment, as previously recited. The method of the present invention may further comprise the step of maintaining the hydrogen halide concentration of the aqueous conductive electrolyte solution circulated through intermediate compartment 16 at a concentration below 25% by weight, preferably below 20% by weight, and more preferably below 15% by weight, based on the total weight of the aqueous conductive electrolyte solution.

In one embodiment of the present invention, and with reference to FIG. 2, the concentration of hydrogen halide within the aqueous electrolyte solution may be controlled by introducing into intermediate compartment 16 an aqueous stream selected from the group consisting of water, aqueous alkali metal hydroxide, e.g., aqueous sodium hydroxide, and a mixture of aqueous alkali metal hydroxide and alkali metal halide, e.g., a mixture of aqueous sodium hydroxide and sodium chloride. More specifically, this aqueous reagent stream may be introduced into reservoir 79 by means of a conduit not shown, and then forwarding the combined streams into intermediate compartment 16 through inlet 40 by means of conduit 58.

Within intermediate compartment 16, the introduced alkali metal hydroxide can combine with hydrogen halide, e.g. hydrogen chloride, to form water and aqueous alkali metal halide, e.g., aqueous sodium chloride, or the introduced water will dilute the aqueous conductive electrolyte solution. The resultant solution exits intermediate compartment 16 through outlet 43 and is forwarded to electrolyte solution reservoir 79 by means of conduits (as represented by line 61, valve 62, and lines 59 and 97 in FIG. 2). The amount of water/reagent introduced into reservoir 79 can be controlled automatically, for example, through the use of a metering device having a pH feed-back control loop, not shown. Depending on the volume of aqueous process stream added, the volume capacity of reservoir 79 may be exceeded, requiring that some of the combined added aqueous stream and aqueous electrolyte solution be removed, e.g., as a bleed stream, from the circulating solution at a convenient point through a conduit, not shown.

In a further embodiment of the invention represented by FIG. 2, the concentration of the hydrogen halide in the aqueous conductive electrolyte solution may alternatively be maintained below 25% by weight by: distilling the aqueous conductive electrolyte solution removed from intermediate compartment 16 in distillation column 82; removing concentrated hydrogen halide distillate and bottoms from the distillation column; and either returning the bottoms to the intermediate compartment, e.g., by forwarding the bottoms to reservoir 79, or by introducing either water or an aqueous conductive electrolyte solution having a concentration of hydrogen halide of less than 25% by weight, based on the total weight of the aqueous conductive electrolyte solution, into the intermediate compartment. More specifically, the aqueous conductive electrolyte solution removed from intermediate compartment 16 either passes (by means of valve 62) into conduit 60 to distillation column 82 or into conduit 59 for recycle to intermediate compartment 16, e.g., through reservoir 79 by means of conduit 97. The aqueous conductive electrolyte solution is distilled in distillation column 82 and a concentrated hydrogen halide distillate and bottoms are removed by means of conduits 85 and 88 respectively. The bottoms may optionally be run through a heat exchanger, not shown, prior to entering valve 91. The valve 91 connecting conduits 88, 94 and 97, may be used to bypass conduit 97 totally or partially by passing all or a portion of the bottoms into conduit 94.

The operation of distillation column 82 results in a reduction in volume of the aqueous conductive electrolyte solution circulated through intermediate compartment 16, in particular when bottoms product is not recycled to the intermediate compartment. As a result, water or an aqueous conductive electrolyte solutioh having a concentration of hydrogen halide of less than 25% by weight, based on the total weight of the aqueous conductive electrolyte solution, is introduced into intermediate compartment 16 to replenish the reduced volume. This can be done by adding make-up water or an aqueous conductive electrolyte solution having a concentration of hydrogen halide of less than 25% by weight, based on the total weight of the aqueous conductive electrolyte solution to reservoir 79 through a conduit not shown.

Distillation columns are well known and are typically operated under conditions that result in favorable or desirable vapor-liquid equilibria. The temperature and the pressure under which a distillation column is operated can be adjusted together to shift the azeotrope point of the mixture being distilled such that a desired concentration of one or more of the components of the mixture may be retrieved. Depending on the nature of the mixture to be distilled, the distillation column can be of the plate type, e.g., crossflow plate or counterflow plate, or packed type.

In the practice of the present invention as represented by FIG. 2, where the hydrogen halide is hydrogen chloride, hydrogen halide distillation column 82 is operated under the following representative conditions: a pressure of from 7.03 $Kg/cm^2$ (100 psi) to 8.44 $Kg/cm^2$ (120 psi); a feed temperature of 24° C. to 35° C.; an overhead temperature of from 32° C. to 43° C.; and a bottoms temperature of from 149° C. to 177° C. Under these conditions the concentrated hydrogen chloride distillate exiting distillation column 82 through conduit 85 has a concentration of hydrogen chloride of from 99% to 99.98% by weight, based on the total weight of concentrated hydrogen chloride distillate. The bottoms exiting distillation column 82 through conduit 88 have a hydrogen chloride concentration of from 12% to 15% by weight, based on the total weight of the bottoms. Distillation column 82 is preferably of the packed type, which uses acid corrosion resistant packing materials, e.g., packing materials based on silicon carbide, and is constructed of sufficiently acid corrosion resistant materials, e.g., titanium, tantalum, stainless steel and TEFLON® polytetrafluoroethylene lined stainless steel.

While FIGS. 1 and 2 depict singular representations of electrolytic cells, it should be understood that the scope of the present invention is also inclusive of the utilization of a plurality of such cells. The present invention may be practiced using a plurality of cells, e.g., electrolytic cells 2 or 4, either in series or parallel. In one embodiment, a plurality of cells, not shown, e.g., electrolytic cell 4, are utilized in series, wherein the outlets 49, 43 and 37 of each preceding cell are in respective communication with the inlets 46, 40 and 34 of each succeeding cell by means of additional conduits, not shown.

In another embodiment of the present invention, a plurality of cells, not shown, e.g., electrolytic cell 4, are utilized in parallel, wherein, for example, inlet 46 and outlet 49 of catholyte compartment 13 of each cell are in common closed loop communication with reservoir 76 by means of conduits and manifolds, not shown. Accordingly, the inlets and outlets of intermediate compartment 16 and anode compartment 10 of each cell are in common closed loop communication with reservoir 79 and reservoir 73 respectively, by means of conduits and manifolds, not shown.

The present invention is more particularly described in the following examples, which are intended to be illustrative only, since numerous modifications and variations therein will be apparent to those skilled in the art. Unless otherwise specified, all parts and percentages are by weight.

EXAMPLE 1

An electrolytic cell, as represented in FIG. 2, was constructed of poly(vinylidene fluoride) and used in this example. The intermediate compartment had a width of 3 millimeters (mm). The catholyte and anode compartments each had an active electrode area of 10 centimeters (cm)×10 cm available for electrochemical reaction. The cathode and the current collecting electrodes were each constructed in a mesh-like configuration of platinum coated titanium. A NEOSEPTA® ACM anion exchange membrane, available from Tokuyama Soda of Japan, was used. A NAFION® 117 cation exchange membrane, available from E.I. Du Pont de Nemours and Company, was used. The hydrogen consuming gas diffusion anode was comprised of 5% by weight of platinum supported on carbon and 95% by weight of TEFLON® polytetrafluoroethylene having a platinum per surface area value of 4 $mg/cm^2$. The hydrogen consuming gas diffusion anode was hot pressed between the NAFION® 117 cation exchange membrane and TEFLON® polytetrafluoroethylene treated carbon cloth comprised of 10% by weight of TEFLON® polytetrafluoroethylene and 90% by weight of carbon.

An aqueous α-halohydrin solution containing 4% by weight of propylene chlorohydrin[a] and 1% by weight of sodium chloride, based on total weight, was circulated through the catholyte compartment at a rate of 180 ml/minute from a temperature controlled stainless steel reservoir using a fluid metering pump. An aqueous conductive electrolyte solution containing 0.5% by weight of hydrogen chloride was circulated through the intermediate compartment at a rate of 15 ml/minute from a temperature controlled stainless steel reservoir using a fluid metering pump. Both of the reservoirs for the catholyte and intermediate compartments were maintained at a temperature of from 22° C. to 32° C. The flow of hydrogen gas through the anode compartment was maintained at a rate of 1000 ml/minute using a mass flow controller with a back pressure of 51 centimeters (cm) of water. The electrolytic cell of Example 1 was operated at a current density of 3 $Kamps/m^2$, and with a limiting cell potential of 5 volts.

[a] The propylene chlorohydrin (obtained commercially from Aldrich Chemical Company, catalogue no. 29,208-7) was composed of 70% by weight of 1-chloro-2-hydroxypropane and 30% by weight of 2-chloro-1-hydroxypropane, based on the total weight of propylene chlorohydrin.

After operating the electrolytic cell of Example 1 as described for 100 minutes, 100% of the original mole equivalents of the propylene chlorohydrin were found to have been converted to propylene oxide[b]. Under these conditions, the electrolytic cell was determined to have operated with a current efficiency[c] of 41.2%.

[b] The percent conversion of propylene chlorohydrin to propylene oxide was determined by comparing gas chromatograph peak areas obtained from samples taken from the catholyte compartment both before and after operation of the electrolytic cell.

[c] Current efficiency was determined using the following equation: 100×{(moles of propylene chlorohydrin originally present)×(96,500)/(total charge actually consumed as measured in Coulombs)}.

EXAMPLE 2

Both an aqueous propylene chlorohydrin solution and hydrogen gas, as described in Example 1, were separately circulated respectively through the catholyte and anode compartments of an electrolytic cell as detailed in Example 1. An aqueous conductive electrolyte solution containing 0.5% by weight of hydrogen chloride and 2% by weight of ethylene diamine, based on total weight, was circulated through the intermediate compartment at a rate of 15 ml/minute from a temperature controlled stainless steel reservoir using a fluid metering pump. Both of the reservoirs for the catholyte and intermediate compartments were maintained at a temperature of from 26° C. to 30° C. The electrolytic cell of Example 2 was operated at a current density of 0.7 to 1.5 Kamps/$m^2$, and with a limiting cell potential of 5 volts.

After operating the electrolytic cell of Example 2 as described for 180 minutes, 98% of the original mole equivalents of the propylene chlorohydrin were found to have been converted to propylene oxide[b]. Under these conditions, the electrolytic cell was determined to have operated with a current efficiency[c] of 57.6%.

EXAMPLE 3

An aqueous solution containing 10% by weight of 1,3-dichloro-2-hydroxypropane and 1% by weight of sodium chloride, based on total weight, was circulated from a temperature controlled stainless steel reservoir at a rate of 180 ml/minute through the catholyte compartment of an electrolytic cell, as described in Example 1. From a separate stainless steel reservoir there was circulated through the intermediate compartment at a rate of 15 ml/minute an aqueous electrolyte solution containing 1% hydrogen chloride by weight, based on total weight. The reservoirs for both the catholyte and intermediate compartments were each maintained at a temperature of from 22° C. to 32° C. Hydrogen gas was circulated through the anode compartment at a rate of 1000 ml/minute using a mass flow controller with a back pressure of 51 cm of water. The electrolytic cell of Example 3 was operated at a current density of 2 Kamps/$m^2$, and with a limiting cell potential of 5 volts.

After operating the electrolytic cell of Example 3 as described for four hours, 99% of the original mole equivalents of 1,3-dichloro-2-hydroxypropane were found to have been converted to 1-chloro-2,3-epoxypropane (epichlorhydrin)[d]. Under these conditions, the electrolytic cell was determined to have operated with a current efficiency[e] of 54%.

[d] The percent conversion of 1,3-dichloro-2-hydroxypropane to 1-chloro-2,3-epoxypropane (epichlorohydrin) was determined by comparing gas chromatograph peak areas obtained from samples taken from the catholyte compartment both before and after operation of the electrolytic cell.

[e] Current efficiency was determined using the following equation: 100×{(moles of 1,3-dichloro-2-hydroxypropane originally present)×(96,500)/(total charge actually consumed as measured in Coulombs)}.

The results of Examples 1 and 2 demonstrate that the conversion of α-halohydrin, e.g., 1-chloro-2-hydroxypropane and 2-chloro-1-hydroxypropane, to epoxide, e.g., propylene oxide, in accordance with the practice of the method of the present invention, can be achieved with high levels of percent conversion, and good current efficiency. Example 3 demonstrates an embodiment of the method of the present invention whereby a halo-substituted α-halohydrin, e.g., 1,3-dichloro-2-hydroxypropane, is electrochemically converted to a halo-substituted epoxide, e.g., 1-chloro-2,3-epoxypropane (epichlorohydrin), with high percent conversion and good current efficiency.

The present invention has been described with reference to specific details of particular embodiments thereof. It is not intended that such details be regarded as limitations upon the scope of the invention except insofar as and to the extent that they are included in the accompanying claims.

We claim:

1. A method of converting α-halohydrin to epoxide comprising:

(a) providing an electrolytic cell having a catholyte compartment containing a cathode assembly, an anode compartment containing an anode assembly, and an intermediate compartment separating said catholyte and anode compartments, said cathode assembly comprising a cathode and an anion exchange membrane, said anode assembly comprising a hydrogen consuming gas diffusion anode and a current collecting electrode, said intermediate compartment being separated from said catholyte and said anode compartments by said anion exchange membrane and said hydrogen consuming gas diffusion anode;

(b) introducing an aqueous solution comprising α-halohydrin into said catholyte compartment;

(c) introducing hydrogen gas into said anode compartment;

(d) introducing an aqueous electrolyte solution into said intermediate compartment;

(e) passing direct current through said electrolytic cell; and (f) removing an aqueous solution comprising epoxide from said catholyte compartment.

2. The method of claim 1 wherein said anode assembly further comprises a hydraulic barrier, said hydrogen consuming gas diffusion anode being fixedly held between said hydraulic barrier and said current collecting electrode, and said intermediate compartment being separated from said anode compartment by said hydraulic barrier.

3. The method of claim 2 wherein said α-halohydrin is selected from the group consisting of 2-chloro-1-hydroxyethane, 1-chloro-2-hydroxypropane, 2-chloro-1-hydroxypropane, 1,3-dichloro-2-hydroxypropane, 1,3-dibromo-2-hydroxypropane, 1-chloro-2-hydroxycyclopentane, 1-chloro-2-hydroxycyclohexane, (α-chloro-hydroxyethyl)cyclohexane, bis(α-chloro-hydroxyethyl)cyclohexane, (α-chloro-hydroxyethyl) benzene, bis(α-chloro-hydroxyethyl)benzene and mixtures thereof.

4. The method of claim 3 wherein said α-halohydrin is selected from the group consisting of 1-chloro-2-hydroxypropane, 2-chloro-1-hydroxypropane, 1,3-dichloro-2-hydroxypropane, 1,3-dibromo-2-hydroxypropane and mixtures thereof.

5. The method of claim 2 wherein said aqueous electrolyte solution comprises an amine.

6. The method of claim 5 wherein said amine is selected from the group consisting of ammonia, monoalkylamines, dialkylamines, trialkylamines, ethyleneamines, alkyl ethylenediamines, propylenediamines, alkyl propylenediamines, monoalkanolamines, dialkanolamines, trialkanolamines, cycloaliphatic amines, aromatic amines and mixtures of such amines.

7. The method of claim 6 wherein said amine is ethyleneamine and is selected from the group consisting of ethylenediamine, diethylenetriamine, triethylenetetramine, tetraethylenepentamine, pentaethylenehexamine, piperazine, 1-(2-aminoethyl)piperazine and mixtures of such ethyleneamines.

8. The method of claim 2 wherein said aqueous electrolyte solution comprises a hydrogen halide aqueous solution having a concentration of from 1% by weight to 25% by weight hydrogen halide, based on the total weight of said aqueous electrolyte solution introduced into said intermediate compartment.

9. The method of claim 8 further comprising maintaining the hydrogen halide concentration of said aqueous electrolyte solution introduced into said intermediate compartment below 25% by weight, based on the total weight of said aqueous conductive electrolyte solution.

10. The method of claim 9 wherein the concentration of hydrogen halide in said aqueous electrolyte solution is maintained below 25% by weight by introducing an aqueous stream selected from the group consisting of water, aqueous alkali metal hydroxide and a mixture of aqueous alkali metal hydroxide and alkali metal halide into said intermediate compartment.

11. The method of claim 9 wherein the concentration of hydrogen halide in said aqueous conductive electrolyte solution is maintained below 25% by weight by distilling aqueous electrolyte solution removed from said intermediate compartment, thereby producing a concentrated hydrogen halide distillate product and bottoms product; and either (a) returning bottoms product to said intermediate compartment or (b) introducing an aqueous stream selected from the group consisting of water and an aqueous electrolyte solution having a concentration of hydrogen halide of less than 25% by weight into said intermediate compartment.

12. The method of claim 2 wherein a positive internal pressure difference of from 0.07 $kg/cm^2$ to 1.40 $kg/cm^2$ exists between said intermediate compartment and each of said catholyte and anode compartments.

13. The method of claim 2 wherein said hydrogen consuming gas diffusion anode comprises platinum supported on carbon dispersed in polytetrafluoroethylene.

14. The method of claim 13 wherein said anion exchange membrane comprises a copolymer of styrene and divinylbenzene having pendent quaternary ammonium salt groups, and said hydraulic barrier is a cation exchange membrane comprising a perfluoropolymer having pendent sulfonic acid groups.

15. The method of claim 14 wherein said cathode and said current collecting electrode each comprises a material selected from the group consisting of graphite, platinum, titanium coated with platinum, titanium coated with an oxide of ruthenium, nickel, stainless steel, high alloy steel and appropriate combinations of such materials.

16. The method of claim 1 wherein said aqueous electrolyte solution comprises an amine, said method further comprising:

(a) providing a second electrolytic cell having a catholyte compartment containing a cathode assembly, an anode compartment containing an anode assembly, and an intermediate compartment separating said catholyte and anode compartments, said cathode assembly comprising a cathode and an anion exchange membrane, said anode assembly comprising a hydrogen consuming gas diffusion anode and a current collecting electrode, said intermediate compartment being separated from said catholyte and said anode compartments by said anion exchange membrane and said hydrogen consuming gas diffusion anode;

(b) removing an aqueous solution comprising amine hydrohalide from the intermediate compartment of said electrolytic cell;

(c) introducing aqueous solution comprising amine hydrohalide removed from the intermediate compartment of said electrolytic cell into said catholyte compartment of said second electrolytic cell;

(d) introducing hydrogen gas into said anode compartment of said second electrolytic cell;

(e) introducing a second aqueous electrolyte solution into said intermediate compartment of said second electrolytic cell;

(f) passing direct current through said second electrolytic cell; and (g) removing an aqueous solution comprising free amine from said catholyte compartment of said second electrolytic cell.

17. The method of claim 16 wherein said anode assembly of each of said electrolytic cell and said second electrolytic cell further comprises a hydraulic barrier, said hydrogen consuming gas diffusion anode being fixedly held between said hydraulic barrier and said current collecting electrode, said intermediate compartment of each of said electrolytic and second electrolytic cells being separated from said anode compartment by said hydraulic barrier, said amine is ethyleneamine and is selected from the group consisting of ethylenediamine, diethylenetriamine, triethylenetetramine, tetraethylenepentamine, pentaethylenehexamine, piperazine, 1-(2-aminoethyl)piperazine and mixtures of such ethyleneamines, said α-halohydrin is selected from the group consisting of 1-chloro-2-hydroxypropane, 2-chloro-1-hydroxypropane, 1,3-dichloro-2-hydroxypropane, 1,3-dibromo-2-hydroxypropane and mixtures thereof, and said second aqueous electrolyte solution comprises a hydrogen halide aqueous solution having a concentration of from 1% by weight to 25% by weight hydrogen halide, based on the total weight of said second aqueous electrolyte solution.

18. The method of claim 17 wherein said hydrogen consuming gas diffusion anode of each of said electrolytic and second electrolytic cells comprises platinum supported on carbon dispersed in polytetrafluoroethylene, said anion exchange membrane of each of said electrolytic and second electrolytic cells comprises a copolymer of styrene and divinylbenzene having pendent quaternary ammonium salt groups, and said hydraulic barrier of each of said electrolytic and second electrolytic cells is a cation exchange membrane comprising a perfluoropolymer having pendent sulfonic acid groups.

19. The method of claim 18 wherein said cathode and said current collecting electrode of each of said electrolytic and second electrolytic cells each comprises a material selected from the group consisting of graphite, platinum, titanium coated with platinum, titanium coated with an oxide of ruthenium, nickel, stainless steel, high alloy steel and appropriate combinations of such materials.

20. The method of claim 17 further comprising the step of introducing at least a portion of said aqueous solution comprising free amine removed from said catholyte compartment of said second electrolytic cell into said intermediate compartment of said electrolytic cell, and wherein a positive internal pressure difference of from 0.07 $kg/cm^2$ to 1.40 $kg/cm^2$ exists between said intermediate compartment and each of said catholyte and anode compartments of each of said electrolytic and second electrolytic cells.

* * * * *